United States Patent [19]

Fuke et al.

[11] Patent Number: 4,812,198

[45] Date of Patent: Mar. 14, 1989

[54] TAB ATTACHING DEVICE USED IN AN AUTOMATIC DEVICE FOR PREPARING PAPER ROLLS FOR WEB PASTING

[75] Inventors: Masanobu Fuke; Takemi Watanabe, both of Osaka; Noriyuki Shiba, Tokyo, all of Japan

[73] Assignees: Kabushiki Kaisha Kaneda Kikai Seisakusho, Osaka; Kabushiki Kaisha Tokoyo Kikai Seisakusho, Tokyo, both of Japan

[21] Appl. No.: 133,976

[22] Filed: Dec. 17, 1987

[30] Foreign Application Priority Data

May 25, 1987 [EP] 05251987 ..... 62-78581[U]

[51] Int. Cl.[4] ..... B65H 19/18; B41F 13/56; B31F 5/06

[52] U.S. Cl. ..... 156/497; 156/505; 156/571; 242/58.5

[58] Field of Search ..... 156/497, 504, 247, 571, 156/580.2, 5.70, DIG. 29, DIG. 31, 505; 242/58.1–58.5

[56] References Cited

U.S. PATENT DOCUMENTS

| | | | |
|---|---|---|---|
| 2,377,971 | 6/1945 | Roesen | 242/58.5 |
| 3,006,568 | 10/1961 | Willis | 242/58.5 |
| 3,231,949 | 2/1966 | Phipps | 242/58.5 |
| 3,285,604 | 11/1966 | Parker | 156/DIG. 29 |
| 4,379,012 | 4/1983 | Heymanns | 156/505 |
| 4,575,017 | 3/1986 | Pali | 156/504 |
| 4,597,820 | 7/1986 | Nozaka | 156/504 |
| 4,683,022 | 7/1987 | Watanabe | 242/58.5 |
| 4,685,392 | 8/1987 | Watanabe | 242/58.5 |

*Primary Examiner*—Michael W. Ball
*Assistant Examiner*—J. Davis
*Attorney, Agent, or Firm*—Griffin, Branigan & Butler

[57] ABSTRACT

The present invention relates to a device used in an automatic device for preparing paper rolls for web pasting, which is included in a printing system for newsprint and the like. The device automatically attaches one end of a tab, which has been prepared beforehand, to the outer surface of a web's leading end so that the web's leading end, which has been cut into a certain shape (for example, V-shaped), may be fastened to the outer surface of a paper roll on which the web is wound.

A tab blank is formed basically by a rectangular support paper, which is provided with adhesive portion's on its upper and lower surfaces, and protective-coating films attached to both surfaces. An upper protective-coating film and the support paper, both of which form a portion of the tab blank, are divided transversely along a dividing line.

The tab attaching device embodying the present invention is comprised of a tab loading device for keeping tab blanks in piles. A tab retaining device takes up and retains a retained portion of the topmost of the tab blanks, which are kept in piles in the tab loading device. A tab transporting/pressing device takes up a nonretained portion (or the applied tab) of the tab blank, and thereby removes the protective-coating film, which is held by the tab retaining device, from the nonretained portions lower side, and adhesively presses one end of the nonretained portion, or tab, whose protective-coating film has been removed from its lower side, to the surface of the web's leading end. A protective-coating film discharging device takes up the lower surface protective-coating film and discharges it.

4 Claims, 8 Drawing Sheets

TAB ATTACHING DEVICE USED IN AN AUTOMATIC DEVICE FOR PREPARING PAPER ROLLS FOR WEB PASTING

BACKGROUND OF THE INVENTION

The present invention relates to a tab attaching device, used in equipment for preparing paper rolls for web pasting, which is included in a printing system for newsprint and the like. The tab attaching device automatically attaches one side of a tab to the outer surface of the web's leading end so that the web's leading end, which is cut into a set shape (for example, V-shape), may be fastened to the outer surface of a paper roll.

As shown in FIG. 14, as a paper roll is continuously fed to a rotary press 51 from an expiring web 52*a* of a first paper roll 52*b* a trailing edge of the expiring web 52*a* is pasted, by means of a pusher 53, to a leading end of a second paper roll 52*c* which is rotated at a rate peripherally equal to the rate at which the expiring first paper web 52*a* is being fed. In FIG. 14 are shown a reel stand 54 and a drive device 55 for the paper rolls 52*b, c,* and *d.*

The automatic pasting of the paper rolls requires that the leading end of the second paper roll 52*c* be prepared beforehand for the adhesive pasting. Generally this preparation is made by a manual procedure in the following manner: As shown in FIG. 15, the leading end of a paper roll 52*c* is cut into a basically V-shaped portion whose tip is attached to the outer surface of the paper roll 52*c* with a tab 56, and pressure sensitive adhesive double coated tape 57 is attached to the outer surface of the V-shaped leading end to form a plurality of adhesive portions.

The manual process required to carry out all of this pasting preparation has been very inefficient and costly. Another problem has been a loss of paper because the manual removal of the peripheral layer is liable to damage inner layers.

Accordingly, various types of automatic devices for web pasting have been developed to solve the problems incidental to the manual preparation for web pasting. Japanese Provisional Publication No. 1986-12561, and U.S. Pat. Nos. 4,685,392 and 4,683,022 exemplify these types of automatic devices for preparing web pasting.

The automatic device for preparing web pasting in Japanese Provisional Publication No. 1986-12561 is comprised of a stand to support a paper roll in such a manner as to allow it to rotate in any direction, a table board on which the web's leading end is placed and supported, and a main preparing device which produces a basically V-shaped incision as well as web pasting adhesive portions and carries out tab attachment. The above-mentioned device automatically operates according to the following procedure: feeds the web's leading end onto the table board, produces a basically V-shaped incision and adhesive portions for web pasting at the web's leading end, cuts and removes the web's leading end along the V-shaped incision, attaches a tab's trailing edge to the basically V-shaped leading end of a paper roll, and attaches a tab leading edge to the outer surface of the paper roll.

As shown in FIG. 16, a prior art main preparing device 58, which forms an important part of a prior-art automatic preparing device for web pasting, is comprised of a housing case 59, a paper feeding device 61 for moving the web's leading end placed on a table board 60 in a set direction, a tape supplying device 63 for feeding a strip-shaped tab 62 of a set length to a top surface of the web's leading end, a cutter device 64 for producing the separating incision on the web's leading end, and an adhesive portion forming device 66 for forming a quantity of adhesive portions by attaching pressure sensitive adhesive double coated tape 65 to the web's leading end. The main preparing device 58 is held on a guide rail (not shown) which is supported so that it may rotate in any direction. At the same time, a front edge of the housing 59 is held so that is may move in a vertical direction.

As shown in FIGS. 17 through 19, when the tab 62 is attached to the leading end of a paper roll 52 by using the main preparing device 58, the basically V-shaped leading end of the paper roll 52 is supplied with the tab 62 of a set length by the tape feeding device 63. One end of the tab is fastened to the V-shaped leading end while the pressure sensitive adhesive double coated tape 65 is also placed thereon by the adhesive portion forming device 66. The web's leading end is rewound and the other end of the tab 62 is fastened to the outer surface of the paper roll with the pressure sensitive adhesive double coated tape 65, which is fed from the adhesive portions forming device 66, being thereon. The above-mentioned procedure presents a problem of inefficiency, as much time is required to attach the tab 62. Furthermore, the tab 62 placed on the web's leading end may slip or be blown off. This may cause incorrect attachment of the tab 62; it may not attach at the desired position of the web's leading end.

In U.S. Pat. Nos. 4,685,392 and 4,683,022 a tab attaching device is placed under a table. A tab prepared beforehand is pushed upwardly through a guide hole in the table, and the one edge of the tab is pressed and fastened to the underside of the web's leading end.

In the above-mentioned U.S. Patents, a protective-coating film removing roller contacts a tab which is retained by means of a vacuum suction. Since the roller removes the protective-coating film from the tab, a slight deviation of the contact pressure between the roller and the protective-coating film may lead to an error in protective-coating film removal or damage to the tab. Tab attachment may be disrupted.

Furthermore, the web's leading end surface needs to be pressed downward by a pressing roller of a main preparing device during tab attachment, while the tab is pressed upwardly toward the underside of the web's leading end. It is rather difficult to fix the interval between the two movements: pressing the tab upward and pressing the web's leading end downward by means of the pressing roller. An incompatible interval may result in an error in tab attachment.

SUMMARY

The present invention has been developed with a view to solving the above-mentioned problems that occur in the tab attaching devices described in Japanese Provisional Publication No. 1986-12561, U.S. Pat. Nos. 4,685,392 and 4,683,022, and purports to accomplish the following objectives:

- a first object is to provide a tab attaching device with which one end of a tab is automatically attached, with high accuracy, at a set position on a web's leading end;
- a second object is to provide a tab attaching device as described above, with which one end of a tab is attached so as to improve the efficiency of web pasting preparation;

a third object is to provide a tab attaching device as described above, with which a tab is not damaged when removing a protective-coating film from it;

a fourth object is to provide a tab attaching device as described above, with which a tab can be easily attached to the outer surface of a web's leading end placed on a table board, merely by pressing the one edge of the tab from above;

a fifth object is to provide a tab attaching device as described above, with which protective-coating film can be removed from a tab easily and with high accuracy.

To meet each of these objects, there is provided a device embodying the present invention which is comprised of a tab loading device where tab blanks are kept in piles. A tab retaining device takes up and retains one end of a topmost tab blank in the tab loading device. A tab transporting/pressing device takes up the other end of the tab blank, and, in combination with the tab retaining device, removes a protective-coating film from an underside of the tab and presses and attaches one end of the tab to the surface of the web's leading end. A protective-coating film discharging device takes up the protective-coating film removed from the tab underside and discharges it.

Tab blanks used in the present invention are comprised of substantially rectangularly shaped support paper. Both surfaces of the support paper are equipped with adhesive portions to which protective-coating films are attached. An upper protective-coating film and the support paper, both of which form the tab blank, are divided into two portions beforehand: the retained portion and the nonretained, or tab, portion.

A tab attaching device embodying the present invention attaches one end of a tab to the web's leading end according to the following procedure:

(1) when a basically V-shaped incision is made on the web's leading end and placed on a table board, the topmost tab blank which is kept in the tab loading device is vacuum-suctioned by the tab retaining device. The surface of the tab blank's retained portion is retained by the tab retaining device.

(2) a tab transporting/pressing device takes up the top surface of the tab blanks nonretained, or tab, portion.

(3) when the tab transporting/pressing device is moved, the upper protective-coating film and the support paper on the nonretained, or tab, portion are pulled away from the lower protective coating film which is held by the tab retaining device. The thusly moved tab, whose protective-coating film on its underside has now been removed, is pressed by the tab transporting/pressing device onto the web's leading end.

(4) one end of the tab is attached to a tip of the V-shaped leading end of the paper roll.

(5) thereafter, the paper roll is rewound. Finally, the other end of the main portion of the tab is pressed and attached to the outer surface of the paper roll by a pressing device.

In practice, a device embodying the present invention exhibits the following advantages:

(1) since one end of the tab is pressed downward by the tab transporting/pressing device onto the web's leading end, which is placed on a table board, the device affords accuracy with respect to tab attachment and assurance against attachment faults.

(2) the device embodying the present invention accurately attaches one end of the tab to the web's leading end, therefore ensuring high precision work.

(3) the device carries out tab attachment speedily and therefore improves efficiency with respect to web pasting preparation.

(4) since the support paper and the protective-coating film on the tab blank surface have been divided into two portions, and the protective-coating film under its surface is removed through the combined operation of the tab retaining device and the tab transporting/pressing device, the protective-coating film under the surface can easily be removed with high accuracy.

(5) no damage is done to the tab when the protective-coating film under its surface is removed.

DETAILED DESCRIPTION OF THE INVENTION

Figure 1:
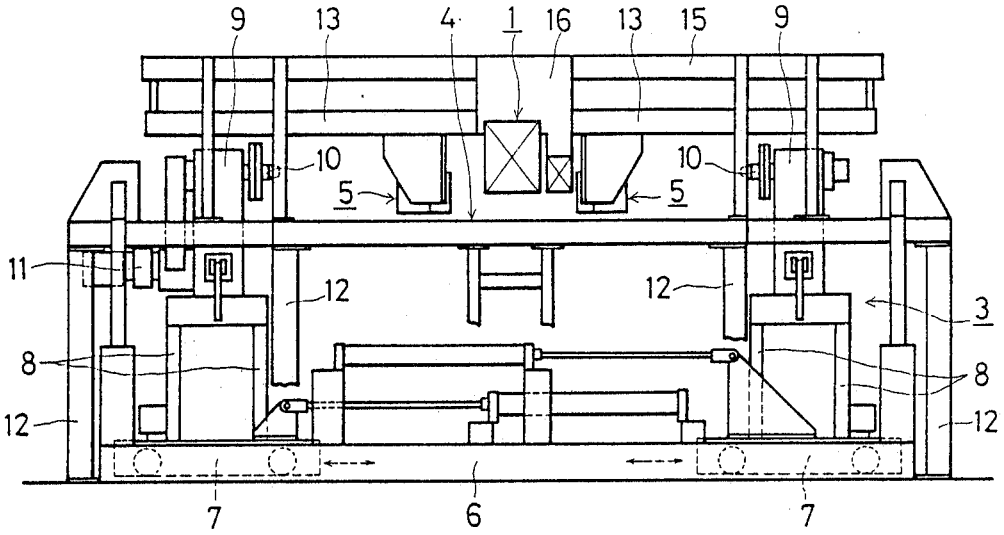
FIG. 1 is a partially cutaway front view of an automatic preparing device for web pasting employing a tab attaching device of this invention.
Figure 2:
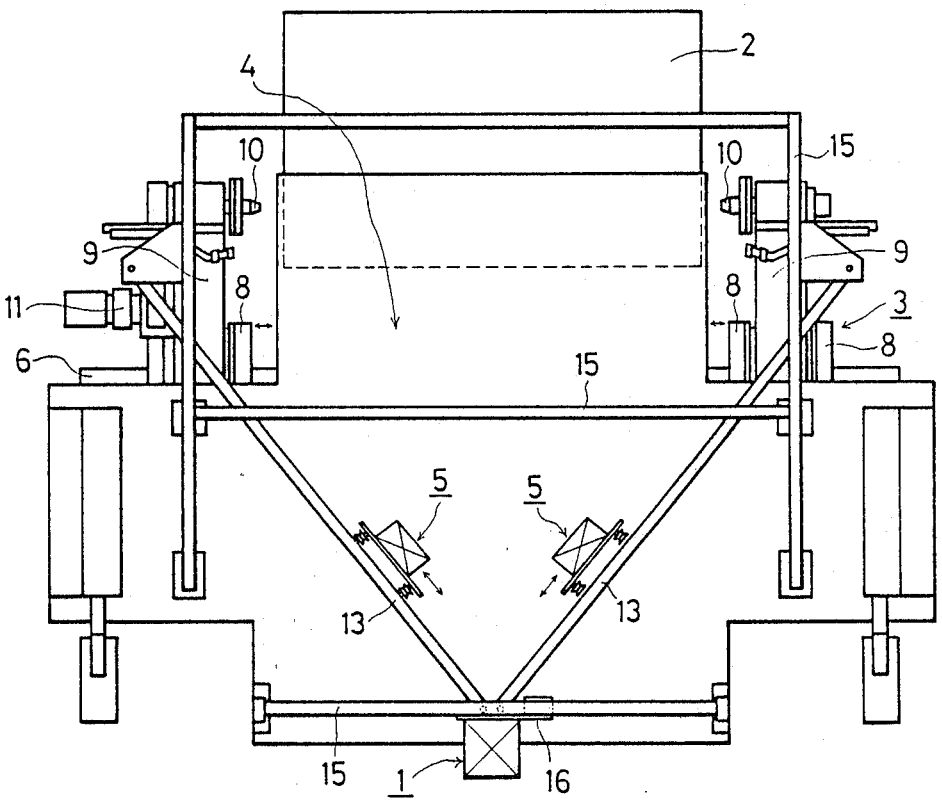
FIG. 2 is a plan view of the automatic preparing device of FIG. 1.
Figure 3:
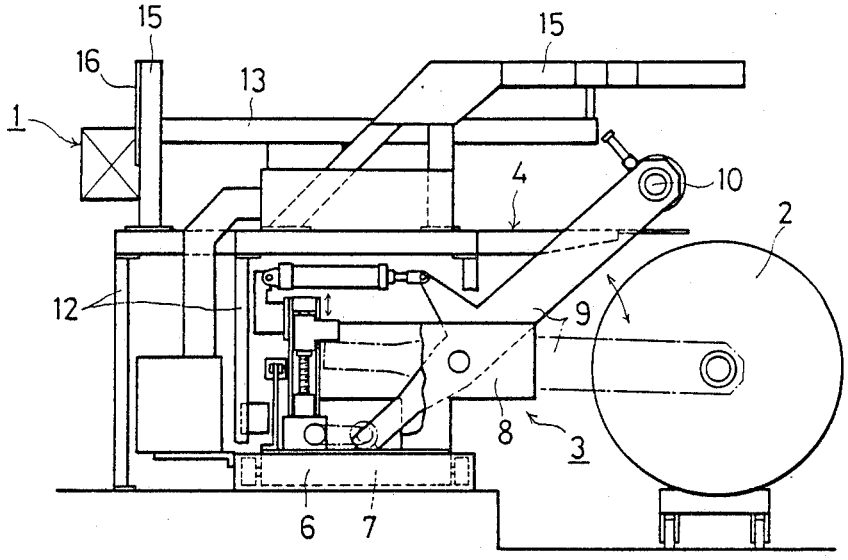
FIG. 3 is a partially cutaway right side view of the automatic preparing device of FIG. 1.

FIGS. 1 through 3 show an automatic preparing device for web pasting employing a tab attaching device 1 according to the present invention. The preparing device is mounted near a feed-in passage for a paper roll which is fed to a rotary press, and is comprised of a supporting device 3, a table board 4, a pair of main preparing devices 5, the tab attaching device 1 and the like.

The supporting device 3 is comprised of a base frame 6, a horizontally movable frame 7, supporting plates 8 held to the movable frame 7, supporting arms 9 held by supporting plates 8 in such a manner as to be movable vertically, rotary shafts 10 held on the supporting arms 9, and a drive portion 11 which drives one of the rotary shafts 10 and which supports a paper roll 2 in such a manner as to be rotatable in two opposite directions.

The supporting device 3 is not limited to the above-mentioned embodiment; a device with any structure or form can be employed so long as it supports a paper roll 2 in such a manner as to be rotatable.

The table board 4 which has a width slightly larger than that of the paper roll 2 is held and supported by means of supporting legs 12 at basically the same level as the topmost portion of the paper roll 2 which is located above the supporting device 3. The table board 4 is a device upon which a leading end of the paper roll 2 is placed. On the table board 4 is built a suction cup device comprised of a number of small openings (not shown) which penetrate the table board 4 and a vacuum pump (not shown) which draws air through the small openings. The suction cup device retains, by means of vacuum-suction, the leading end of the paper roll 2 placed on top of the table board 4.

The main preparing devices 5 are held, by a pair of guide rails 13 located in such a manner as to incline at a given angle in the direction of a core axis of the paper roll 2, so as to move in the directions shown by arrows in FIG. 2. Each of the main preparing devices 5 is equipped with a cutter device (not shown) for producing a separation incision on the leading end of the paper roll 2 which is placed on top of the table board 4, and an adhesive portion forming device (not shown) for forming a pasting adhesive portion at the leading end of the paper roll 2 by attaching pressure sensitive adhesive double coated tape thereto.

When both of the main preparing devices 5 move synchronously in the same direction along the guide rail 13, the cutter devices as well as the adhesive portion forming devices start to operate. At this time, basically V-shaped incision as well as pasting adhesive portions are produced on the leading end of the paper roll 2.

The tab attaching device 1 which is placed above the basically V-shaped leading end of the paper roll 2 placed on top of the table board 4 attaches one end of a tab **14*b* (FIG. 12), whose lower protective-coating film is removed, to the basically V-shaped leading end of the paper roll 2**.

Figure 4:
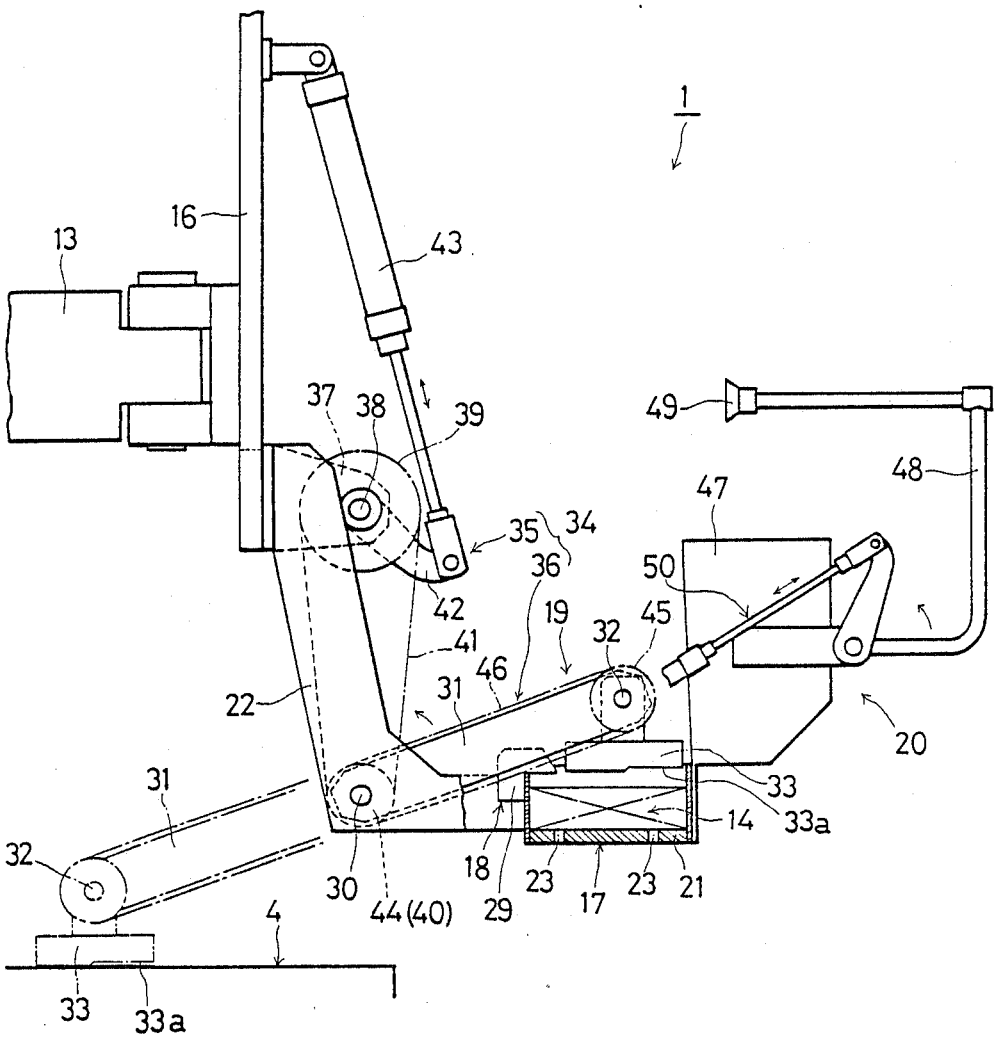
FIG. 4 is a fragmented, partially cutaway, side view of the tab attaching device in the automatic preparing device of FIG. 1.
Figure 5:
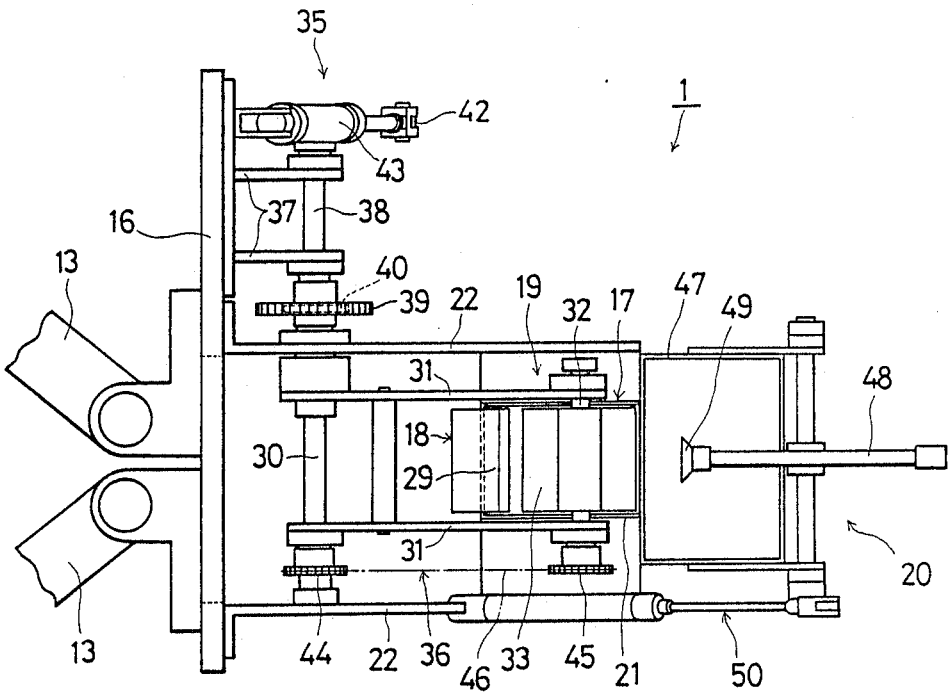
FIG. 5 is a fragmented plan view of the tab attaching device of FIG. 4.

The tab attaching device 1 is held by a plate 16 fixed to the table board 4 and, as shown in FIGS. 4 and 5, is comprised of a tab loading device 17, a tab retaining device 18, a tab transporting/pressing device 19, a protective-coating film discharging device 20 and the like.

The tab loading device 17 is equipped with a tab box 21 which has an open top and keeps a quantity of tab blanks 14 in piles. The tab box 21 is held by a bracket 22 which is attached to the fixed plate 16. Air blasts upwardly through the openings 23 placed at the bottom of the tab box 21, push up the piled tab blanks 14. Though not shown in the figure, one of the side walls of the tab box 21 can be opened and closed so that the tab blanks 14 can be packed into the tab box 21 from the side. The side wall is made of a transparent material so that the remaining tab blanks 14 in the tab box 21 can be visually checked.

The tab loading device 17 is not limited to the above-mentioned embodiment: a device with any structure or form can be employed so long as it can keep the tab blanks 14 in piles and its installation position is arbitrary.

Figure 6:
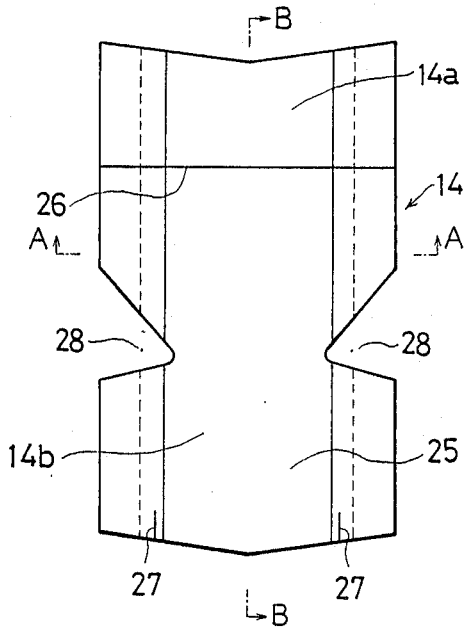
FIG. 6 shows a plan view of an inventive tab blank of this invention.
Figure 7A:
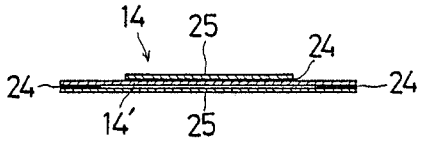
FIG. 7A is a sectional view taken along plane A—A of FIG. 6.
Figure 7B:
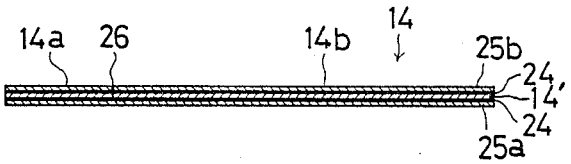
FIG. 7B is a sectional view taken along plane B—B of FIG. 6.

As shown in FIGS. 6, 7A, and 7B, each tab blank 14 kept in the tab loading device 17 is basically rectangular. The tab blank 14 is formed by a support paper 14' whose surface center and reverse-side portions are respectively provided with adhesive portions 24. Both lower and upper surfaces of the support paper are covered with lower and upper protective-coating films **25*a* and *b*. The upper protective-coating film 25*b* and the support paper 14 on the tab blank 14 are divided into two portions around one end of the tab blank 14 by a dividing line incision 26**.

On one side of the incision 26 of the tab blank 14 a retained portion **14*a* is formed which is picked up and held by the tab retaining device 18 (as is later described) while on the other side of the incision 26 a nonretained portion, or tab, 14*b* is formed whose underside protective-coating film 25** is removed when it is attached to the web's leading end.

On the nonretained portion, or tab, **14*b*, are formed incisions 27 for aiding in separating a web leading end from the outer surface of its roll. The tab 14 can be torn along the incisions 27** so that that portion of the tab attached to the leading end remains with the leading end and those portions attached to the outer surface of the paper roll remain with the paper roll when a paper roll is continuously fed to a rotary press by means of the device of this invention.

The tab **14*b* is provided with cuts 28 sideways so that one end of the tab 14*b* may basically be in the same shape as a tip of the V-shaped leading end of the paper roll 2** when they are attached together.

The tab retaining device 18 is comprised of a vacuum-suction box 29 which is placed on one side of the periphery wall of the tab box 21, a vacuum pump (not shown) which is connected to the vacuum-suction box 29 picks up, piece by piece, the topmost of the tab blanks 14 kept in the tab box 21, gripping the retained portions **14*a*** thereof.

The tab retaining device 18 is not limited to the above-mentioned embodiment: a device with any structure or form can be employed so long as it can pick up and retain the retained portion **14*a* of the tab blank 14**.

The tab transporting/pressing device 19 is comprised of: a first supporting shaft 30, which is supported by the bracket 22 in such a manner as to be rotatable; a movable arm 31, whose one end is held by the first supporting shaft 30; a second supporting shaft 32, which is supported by the other end of the movable arm 31 in such a manner as to be rotatable; a vacuum suction cup 33, which is held by the second supporting shaft 32 and picks up the nonretained tab portion **14*b* while the retained portion 14a is retained by the tab retaining device 18; a vacuum pump (not shown), which is connected to the vacuum-suction device 33; a drive device 34, which moves the vacuum suction cup 33 within a range from a tab take-up position (shown by full line in FIG. 4) to a tab attaching position (shown in phantom in FIG. 4) by rotating the movable arm 31, and the like. The tab transporting/pressing device 19 picks up the tab blank 14 which is also held in the tab retaining device 18 by means of the vacuum-suction device 33, removes the protective film cover 25 from the nonretained portion, or tab, 14*b* in combination with the tab retaining device 18, moves the tab 14*b*, whose protective-coating film is removed, to a top of a basically V-shaped leading end of the paper roll 2 placed on tip of the table board 4, and attaches one end of the tab 14*b*** to the tip surface of the basically V-shaped leading end.

The drive device 34 for the tab transporting/pressing device 19 is comprised of a first drive device 35 which moves and rotates the movable arm 31 for a given distance and a second drive device 36 which moves and rotates the vacuum suction cup 33 for set distances in accordance with movement of the movable arm 31 so that the vacuum suction cup 33 can come to a tab attaching position while maintaining a certain attitude.

More specifically, the first drive device 35 is comprised of: a shaft 38, which is supported in such a manner as to be rotatable by means of a bracket 37 held by the fixed plate 16; a drive sprocket 39 mounted on the shaft 38; a driven sprocket 40 mounted on the first supporting shaft 30; a chain 41 wound about both of the drive and driven sprockets 39 and 40; a link 42 held by the supporting shaft 38; and a cylinder 43 set between the fixed plate 16 and the link 42. When the cylinder 43 is expanded, the first supporting shaft 30 rotates by means of sprockets 39 and 40 and the chain 41. Accordingly, the movable arm 31 moves and rotates for a set distance.

The second drive device 36 comprises a drive sprocket 44 which is mounted on the first supporting shaft 30, a driven sprocket 45 which is mounted on the second supporting shaft 32, and a chain 46 wound about both the drive and driven sprockets 44 and 45. When the first supporting shaft 30 rotates, the second supporting shaft 32 starts rotating by means of the sprockets 44, 45, and the chain 46. Accordingly, the vacuum suction cup 33 is made to move and rotate for a set distance.

The vacuum suction cup 33 is provided with a recess **33*a* at its bottom so that one end of the tab 14*b* may not stick to the tip of the table board 4 when the other end of the tab 14*b* is attached to the basically V-shaped leading end of the paper roll 2**.

The tab transporting/pressing device 19 is not limited to the above-mentioned embodiment; a device with any structure or form can be employed so long as it can take up the tab nonretained portion while the retained portion **14*a* is retained by the tab retaining device 18, thereby remove the protective film cover 25 from the tab 14*b* in combination with the tab retaining device 18, and attach one end of the tab 14*b* whose protective-coating film is removed to the surface tip of the basically V-shaped leading end of the paper roll 2**.

Figure 11:
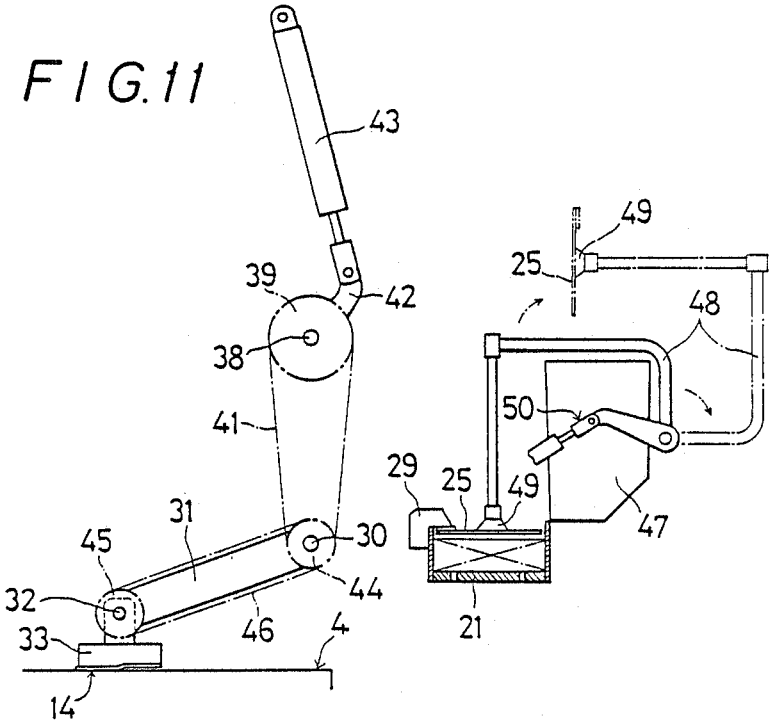

The protective-coating film discharging device 20 is comprised of a protective-coating film box 47 having an open top which is attached to the tab box 21, an arm 48 which is supported by the protective-coating film box 47 in such a manner as to be movable and rotatable, a suction cup 49 which is attached to the arm 48 and takes up the removed protective film cover 25, a vacuum pump (not shown) which is connected to the suction cup 49, and a drive device 50 whose link and cylinder rotates the arm 48 to move the suction cup 49 within a range between a protective-coating film take-up position (shown by solid lines in FIG. 11) and a protective-coating discharging position (shown in phantom in FIG. 11). The protective-coating film discharging device takes up the removed protective film cover 25 and discharges it into the protective-coating film box.

The protective-coating film discharging device is not limited to the above-mentioned embodiment; a device with any structure or form can be employed so long as it can discharge and dispose of the removed protective film cover 25.

Though not shown in the figures, a protective-coating film removal inspector for checking the protective-coating film removal is placed at a proper position in this embodiment. A light-sensitive detector is employed in the inspector. The lower edge of the fixed plate 16 is partially cut off so that the vacuum suction cup 33 and the movable arm 31 may not collide with the fixed plate 16 when the vacuum suction cup 33 is displaced from a tab take-up position to a tab attaching position.

Operation of the tab attaching device 1 is now described hereinafter.

Figures 8, 9:
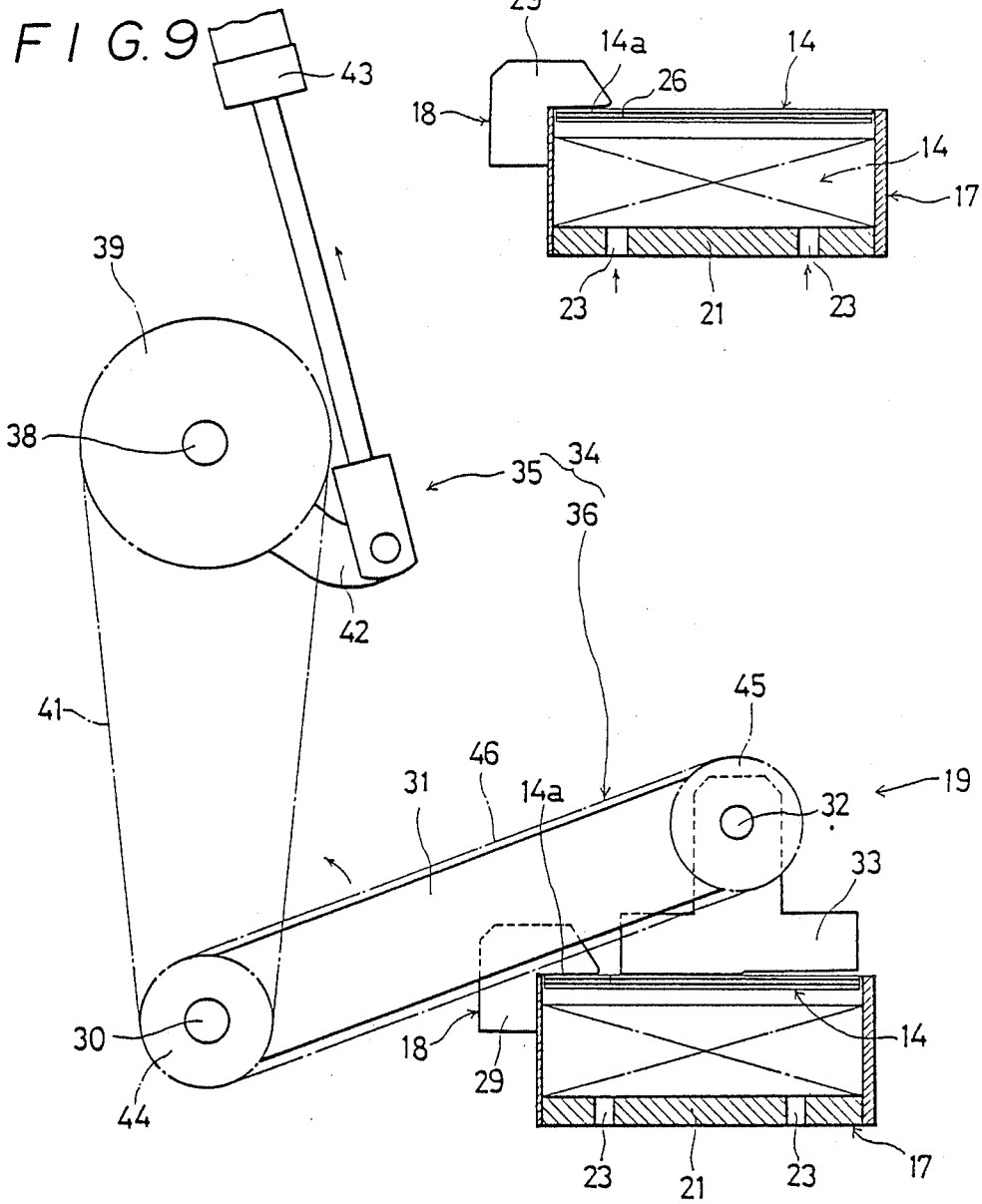
FIGS. 8 through 11 are schematic side views showing operation of the tab attaching device of FIG. 4.

The tab blanks 14 in the tab box 21 are pushed upwardly by the air blasting through openings 23 placed at the bottom of the box, and the topmost tab blank 14 is taken up and retained by the vacuum suction box 29 of the tab retaining device 18 (Refer to FIG. 8.). At this time, the retained portion **14*a* of the tab blank 14 is held by the vacuum suction box 29**.

Figure 10:
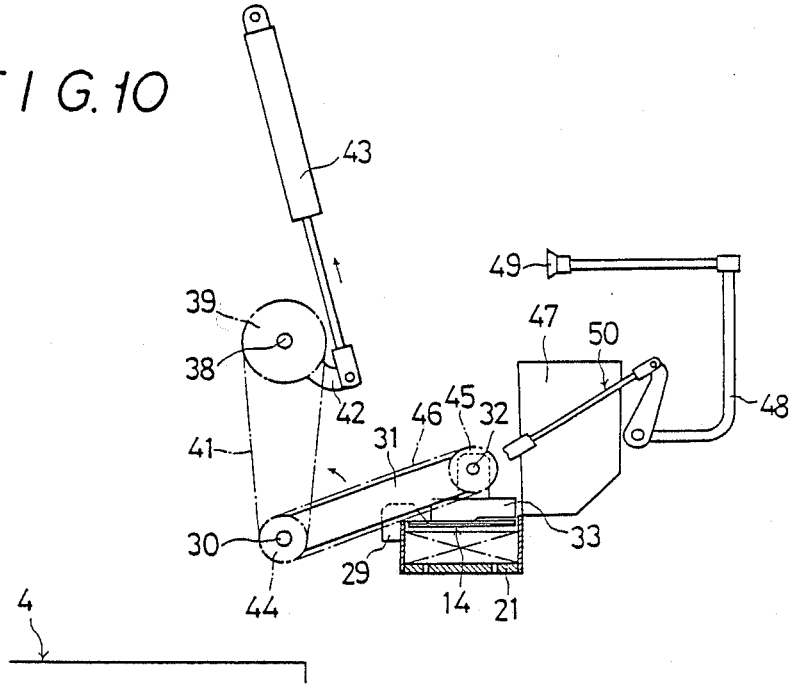

When the tab retaining device 18 retains the tab blank 14, the tab transporting/pressing device 19 starts to operate and the vacuum suction cup 33 takes up and retains the surface of the tab nonretained portion, or tab, **14*b* (refer to FIGS. 9 and 10**).

When the vacuum suction cup 33 takes up and retains the tab **14*b*, the drive device 34 causes the movable arm 31 to move and rotate, displacing the vacuum suction cup 33 from the tab take-up position to the tab attaching position (FIG. 11). At this time, since the retained portion 14*a* is held by the vacuum suction box 29 and the incision 26 is made for facilitating detachment of the tab nonretained portion 14*b* (excluding the retained portion 14*a*) from the lower protective film cover 25*a*, the tab nonretained portion 14*b* is separated along the incision 26 when the vacuum suction cup 33 is displaced from a tab take-up position to a tab attaching position. When the tab nonretained portion 14*b* having the corresponding portion of the upper film 25*b* stuck thereon is moved to the tab attaching position the whole lower protective film cover 25*a* is separated from the tab nonretained portion 14*b* and left in the box 21**.

Figure 12:
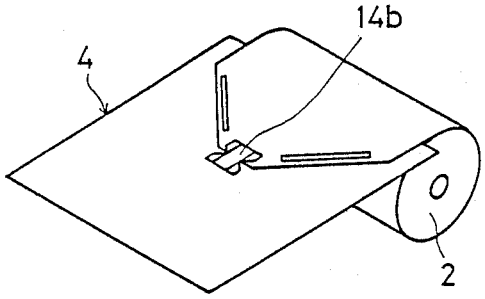
FIG. 12 is a perspective view in which one end of a tab is attached to a web's leading end.
Figure 14:
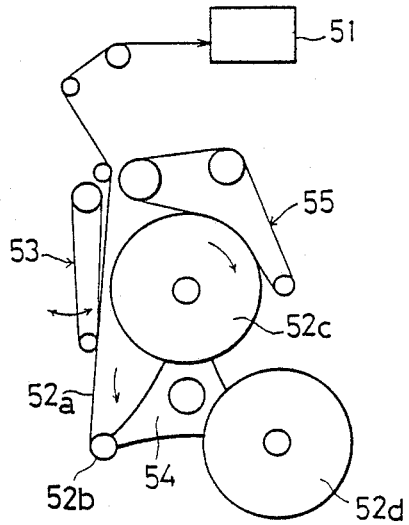
FIG. 14 illustrates schematically paper supplied by a rotary press according to prior art.

When the tab nonretained portion **14*b* reaches the tab attaching position, one end of the tab nonretained portion 14*b* having the lower adhesive layers 24 thereunder is attached, by means of pressng action of the vacuum suction cup 33, to the tip of the surface of the basically V-shaped leading end of the paper roll 2 placed on the table board 4 (FIG. 12). At this time, the other end of the tab nonretained portion 14*b* does not stick to the top of the table board 4 since the recess 33*a* is formed at the bottom of the vacuum suction cup 33**.

The lower protective film cover **25*a* having the retained portion 14*a* thereon which has been gripped by the tab retaining device 18 is taken by the suction cup 49 of the protective-coating film discharging device 20, carried above the protective-coating film box 47, and is discharged into the box. When the suction cup 49 grips the lower protective film cover 25*a*, the tab retaining device 18 stops its operation for letting the retained portion 14*a*** loose.

Figure 13:
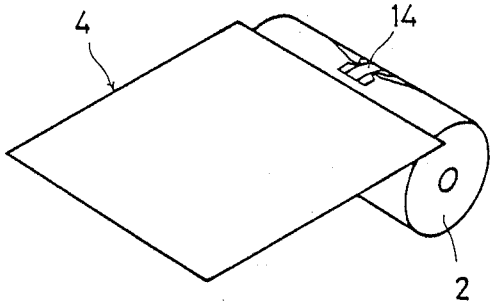
FIG. 13 is a perspective view in which the other end of a tab is attached to the outer surface of a paper roll.
Figure 15:
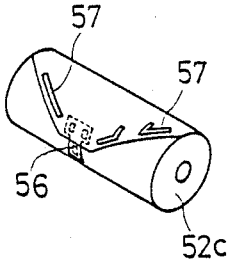
FIG. 15 is a perspective view of a paper roll manually prepared for web pasting.
Figure 16:
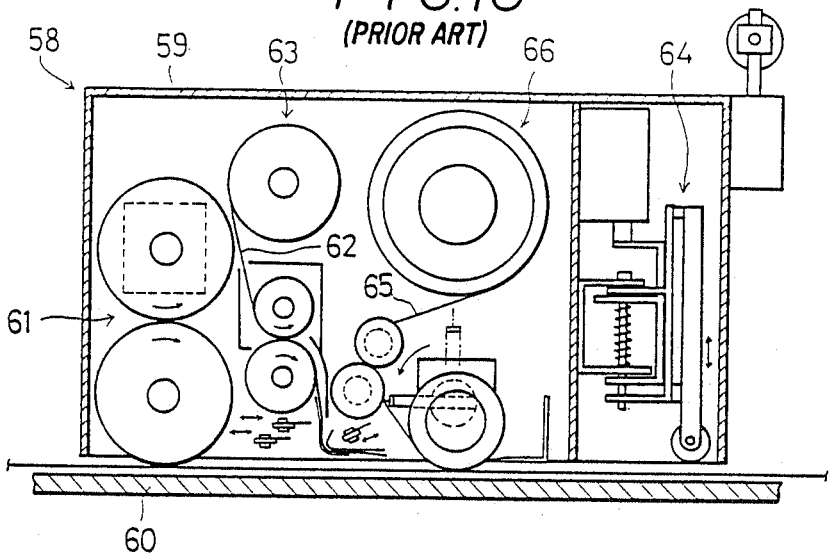
FIG. 16 (PRIOR ART)
FIG. 16 is a vertical sectional view of a main preparing device according to the prior art.
Figure 17:
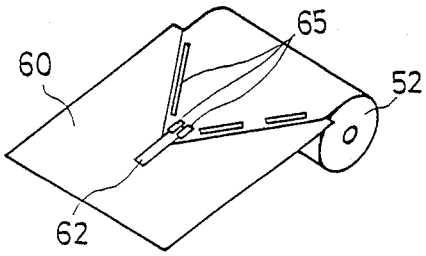
FIGS. 17 through 19 are perspective views showing tabs attached to paper rolls by a main preparing device of this invention.
Figure 18:
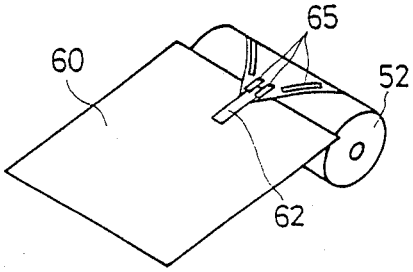
Figure 19:
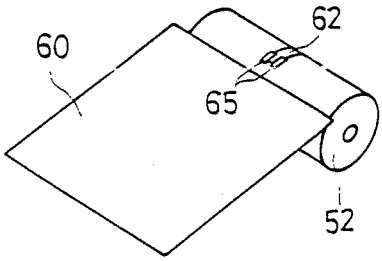

When the tab nonretained portion **14*b* is attached to the tip of the surface of the basically V-shaped leading end of the paper roll 2, the paper roll 2 is rewound. Finally, the other end of the tab 14 is attached to the outer surface of the paper roll 2 (FIG. 13**).

The tab 14 is attached to the paper roll 2 according to the above mentioned steps.

All the above-mentioned operations of the devices are automatically conducted according to predetermined signals coming from control units.

The embodiments of the invention in which an exclusive property or privilege are claimed are defined as follows:

1. A device for attaching one end of a tab to a leading end of a paper roll, with a tab blank comprising a substantially elongated rectangular support paper, adhesive layers provided on the upper and lower surfaces of the support paper, and upper and lower protective-coating films provided on the adhesive layers, with the upper protective-coating film and the support paper being divided into first and second parts along a transverse line at one end, which comprises:

a tab loading device for keeping tab blanks in a pile;

a tab retaining device for taking and holding the first part of the upper protective-coating film and the support paper and the lower protective-coating film of the topmost of the tab blanks which are kept in a pile in the tab loading device;

a tab transporting/pressing device for gripping the second part of said upper protective-coating film and said support paper and transporting them away from said tab retaining device while said tab retaining device is holding said first parts of the upper protective-coating film and the support paper and the lower protective-coating film to thereby remove the lower protective-coating film from the lower side of the second part of said support paper and, thereafter, transferring and pressing one end of the second part of said support paper whose lower protective-coating film has been removed, onto the surface of the leading end of the paper roll; and a protective-coating film discharging device for carrying away for disposal the lower protective-coating from said tab retaining device.

2. A tab attaching device as claimed in claim 1, wherein said tab retaining device operates by vacuum-suction.

3. A tab attaching device as claimed in claim 1, wherein said tab loading device, said tab retaining device, and said tab transporting/pressing device are placed above a table board on which said leading end of said paper roll is placed when said one end of said tab is attached thereto.

4. A tab attaching device as claimed in claim 1, wherein said tab transporting/pressing device, which has a vacuum suction cup, is provided with a recess at its bottom surface.

* * * * *